US005823819A

United States Patent [19]

Kondo et al.

[11] Patent Number: 5,823,819

[45] Date of Patent: Oct. 20, 1998

[54] ELECTRIC JUNCTION BOX

[75] Inventors: Kazuharu Kondo; Tohru Yamaguchi; Kazuaki Yokoyama, all of Shizuoka, Japan

[73] Assignee: Yazaki Corporation, Tokyo, Japan

[21] Appl. No.: 870,737

[22] Filed: Jun. 6, 1997

[30] Foreign Application Priority Data

Jun. 7, 1996 [JP] Japan ..... 8-146226

[51] Int. Cl.[6] ..... H01R 13/00

[52] U.S. Cl. ..... 439/487; 439/949

[58] Field of Search ..... 439/76.2, 949, 439/212, 885, 487

[56] References Cited

U.S. PATENT DOCUMENTS

| | | | |
|---|---|---|---|
| 4,959,018 | 9/1990 | Yamamoto et al. | 439/76.2 |
| 5,207,591 | 5/1993 | Ozaki et al. | 439/212 |
| 5,310,353 | 5/1994 | Parrish et al. | 439/76.2 |

FOREIGN PATENT DOCUMENTS

| | | | |
|---|---|---|---|
| 62-47456 | 3/1987 | Japan | B60R 16/02 |
| 3-91016 | 9/1991 | Japan | H02G 3/16 |
| 3-127428 | 12/1991 | Japan | H02G 3/16 |
| 5-260628 | 10/1993 | Japan | H02G 3/16 |

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

An electric junction box in which electric power is distributed to electric parts or devices, mounted on an upper side of a part-mounting floor portion of an upper case, through bus bars mounted on a lower side of the part-mounting floor portion. In the electric junction box, a peripheral wall of an upper case has a heat-radiating wall portion which projects upwardly beyond the position of mounting of the electric parts on the part-mounting floor portion of the upper case. The heat-radiating wall portion has a bus bar installation space of a slit-like cross-section which is open to the lower surface of the part-mounting floor portion, and receives the connecting plate of the bus bar.

5 Claims, 3 Drawing Sheets

ELECTRIC JUNCTION BOX

BACKGROUND OF THE INVENTION

1. Field of the Invention

This invention relates to an electric junction box in which electric power is distributed to electric parts or devices, mounted on an upper side of a part-mounting floor portion of an upper case, through bus bars mounted on a lower side of the part-mounting floor portion.

2. Description of Related Art

For efficiently distributing electric power to various electric parts on an automobile, there is known a method of using a bus bar having a plurality of tab terminals for branch connection purposes.

FIG. 5 shows a conventional electric junction box for distributing electric power to a plurality of electric parts, using such bus bars.

The electric junction box 1, shown in this figure, is disclosed in Japanese Patent Unexamined Publication No. Hei. 5-260628, and comprises an upper case 3 made of an insulative resin, a lower case 5 made of an insulative resin to be mounted on a lower side of the upper case 3, and bus bars 7 provided between the upper case 3 and the lower case 5.

The bus bar 7 of an integral construction is formed by pressing a metal sheet, and includes a plurality of tab terminals 8 to be connected to electric parts, and a connecting plate 9 interconnecting the plurality of tab terminals 8 to serve as a feeding path for these tab terminals 8.

The upper case 3 has a substantially box-like shape defined by a part-mounting floor portion 11, on which electric parts are adapted to be mounted, and an upstanding peripheral wall 12 formed at the periphery of the part-mounting floor portion 11. Electric part-mounting housing portions 14, into which the tab terminals 8 can be inserted from the lower side of the part-mounting floor portion 11, and a fuse cavity 17 for enabling fuses 16 to be connected to the respective bus bars 7, are formed on and projected from the upper surface of the part-mounting floor portion 11. The bus bars 7 are mounted on the lower side of the part-mounting floor portion 11 in such a manner that the tab terminals 8 are inserted into the associated housing portions 14.

The lower case 5 has a substantially box-like shape, and is attached to the lower side of the upper case 3 to cover the bus bars 7 mounted on the lower side of the part-mounting floor portion 11 of the upper case 3. Slits 19 and recesses 20 for positioning the bus bars 7 are formed in the lower case 5 as required, and the lower case 5 has housing portions 23 for enabling downwardly-projecting tab terminals 22 of the bus bars 7 to be connected to electric parts.

In the above electric junction box 1, the connecting plate 9 of each bus bar 7, serving as the feeding path for distributing electric power, is fully exposed to a space on the lower side of the upper case 3, and heat, radiated from the bus bars 7, is kept within the space formed between the upper case 3 and the lower case 5, so that the temperature of the whole of the electric junction box 1 increases, and this leads to a possibility that the electric parts, mounted on the part-mounting floor portion 11, are adversely affected, and also to a possibility that electrical connection characteristics of contact portions, subjected to a connection treatment, within the electric junction box are degraded.

For preventing the temperature rise within the electric junction box due to the heat radiated from the bus bars, there have heretofore been proposed a technique (Japanese Utility Model Unexamined Publication No. Hei. 3-127428) in which separate ducts are provided for circulating the air within the electric junction box, and a technique (Japanese Utility Model Unexamined Publication No. Hei. 3-91016) in which vent holes, through which the connecting plates of the bus bars are partially exposed to the exterior of the case, are formed in the upper case or the lower case.

However, in the method of providing the separate ducts in the electric junction box, when mounting the electric junction box on a vehicle, the separate ducts must be mounted in addition to assembling the electric junction box, and this results in problems that the efficiency of the work is lowered and that the cost increases with the increased number of the component parts.

On the other hand, in the method of providing the vent holes, through which the connecting plates of the bus bars are partially exposed to the exterior of the case, in the upper case or the lower case, dust and rain water intrude into the electric junction box through the vent holes, which results in a problem that the lifetime of the electric connection portion within the electric junction box is shortened.

SUMMARY OF THE INVENTION

With the above problems in view, it is an object of this invention to provide an electric junction box in which heat, radiated from a connecting plate of a bus bar, can be rapidly discharged to the exterior of the electric junction box without the need for providing a separate duct or the like, thereby preventing a temperature rise within the electric junction box, and also preventing a shortened lifetime of an electric connection portion due to the intrusion of dust and rain water, and the efficiency of mounting the electric junction box on a vehicle, as well as the reliability of an electrical connection treatment, is enhanced, and the cost can be reduced.

In order to achieve the above object, the invention provides an electric junction box comprising: a bus bar of an integral construction which is formed by pressing a metal sheet, and includes a plurality of tab terminals to be connected to electric parts, and a connecting plate interconnecting the plurality of tab terminals to serve as a feeding path for the tab terminals; and an upper case which has a substantially box-like shape defined by a part-mounting floor portion, on which the electric parts are adapted to be mounted, and an upstanding peripheral wall formed at an periphery of the part-mounting floor portion, the bus bar being mounted on a lower side of the part-mounting floor portion, with the tab terminals passing through the part-mounting floor portion, wherein a bus bar installation space, which receives the connecting plate of the bus bar, is formed in the peripheral wall of the upper case.

DETAILED DESCRIPTION OF THE PREFERRED EMBODIMENT

A preferred embodiment of an electric junction box of the invention will now be described in detail with reference to the drawings.

Figure 1:
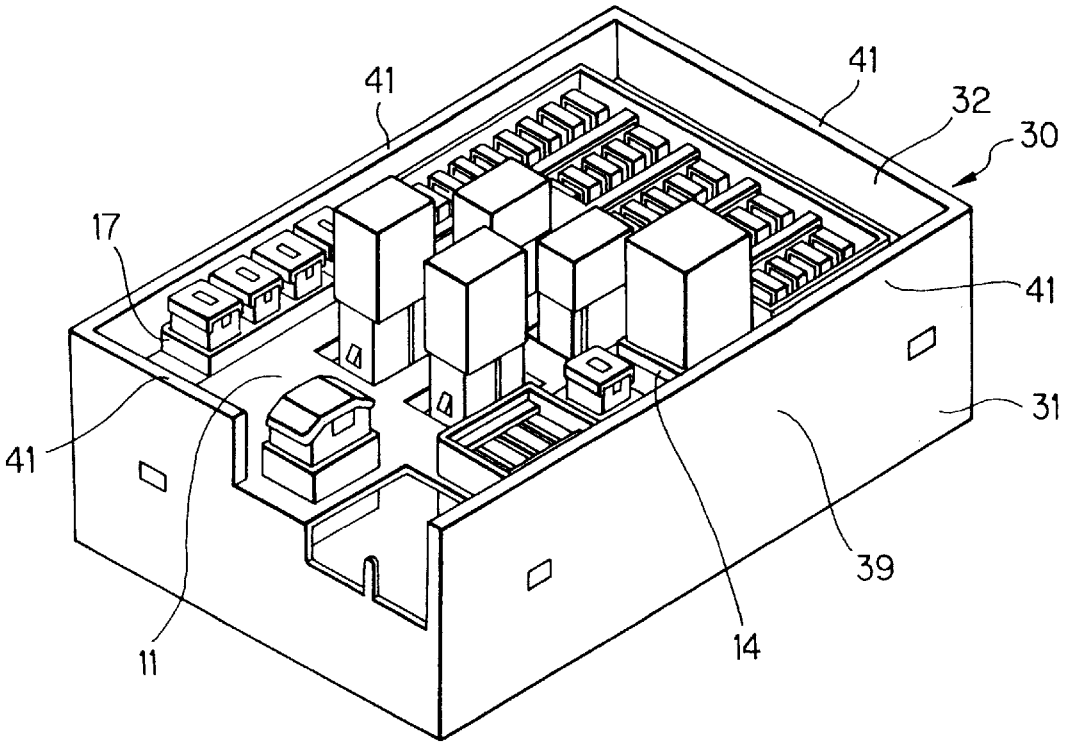
FIG. 1 is a perspective view showing the appearance of an upper case of an embodiment of an electric junction box of the present invention.
Figure 2:
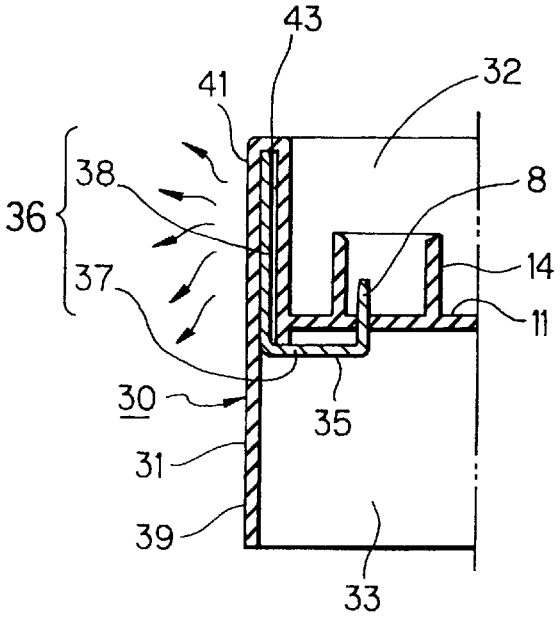
FIG. 2 is a cross-sectional view of an important portion of the upper case shown in FIG. 1.
Figure 3:
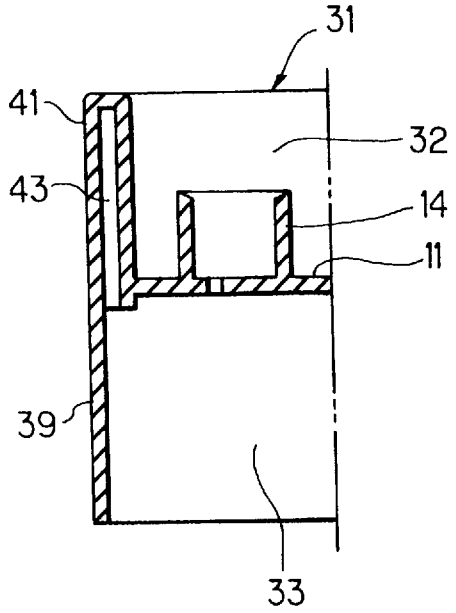
FIG. 3 is a cross-sectional view of the important portion of the upper case shown in FIG. 1, with bus bars removed.
Figure 4:
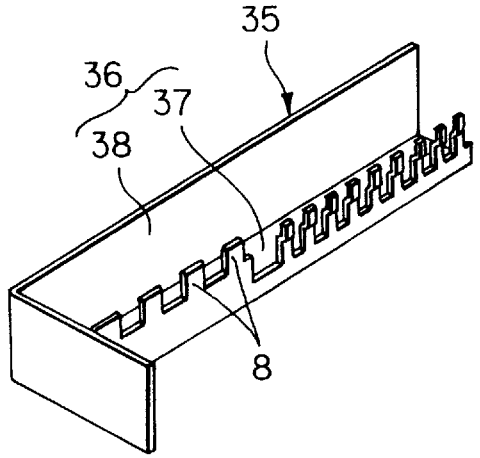
FIG. 4 is a perspective view of a bus bar to be mounted on the upper case shown in FIG. 1.
Figure 5:
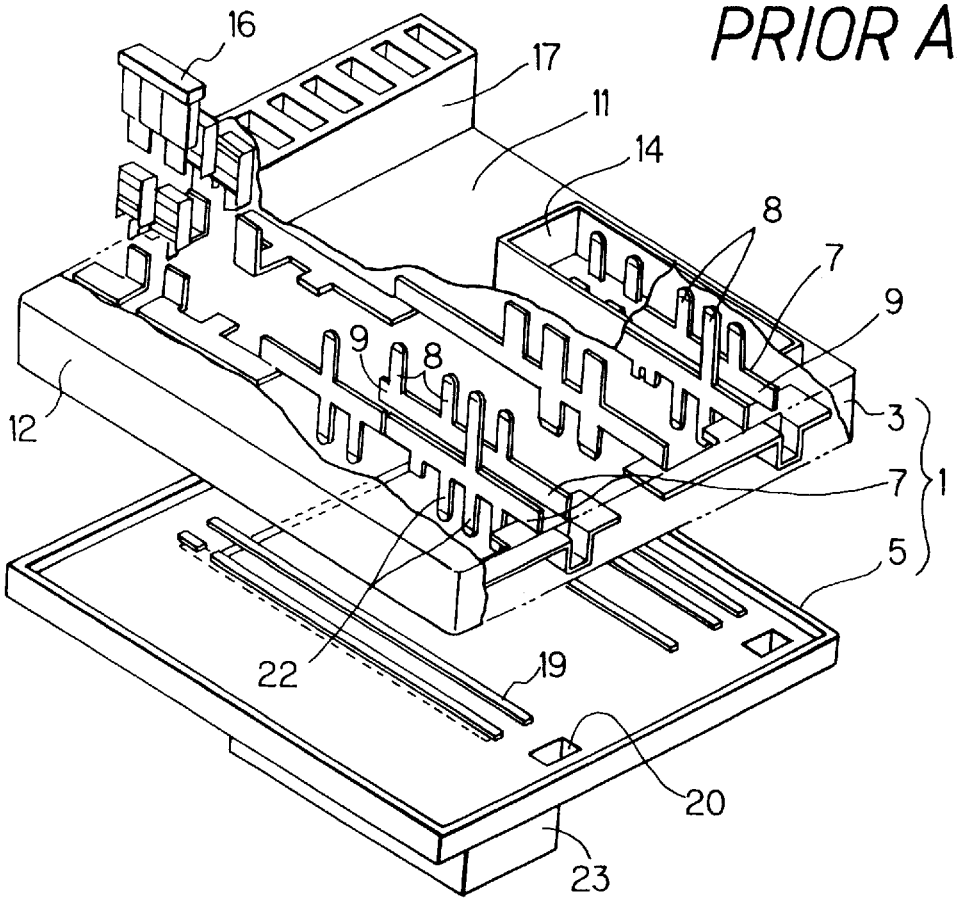
FIG.5 PRIOR ART
FIG. 5 is an exploded, perspective view showing the construction of a conventional electric junction box.
Figure 6:
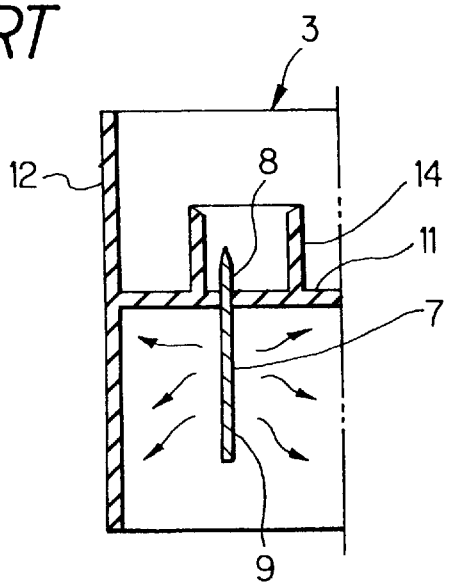
FIG.6 PRIOR ART
FIG. 6 is a cross-sectional view explanatory of a problem with the electric junction box of FIG. 5.

FIGS. 1 to 4 show a preferred embodiment of the electric junction box of the invention, and FIG. 1 is a perspective view showing the appearance of an upper case of the electric junction box of the invention, FIG. 2 is a cross-sectional view of an important portion of the upper case shown in FIG. 1, FIG. 3 is a cross-sectional view of the important portion of the upper case shown in FIG. 1, with bus bars removed, and FIG. 4 is a perspective view of a bus bar to be mounted on the upper case shown in FIG. 1.

The electric junction box 30 comprises an upper case 31, a lid (not shown) for covering an open top 32 of the upper case 31, a lower case (not shown) to be mounted on a lower side of the upper case 31 to cover an open bottom 33 of the upper -case 31, and power-distributing bus bars 35 provided in a space between the lower case and the upper case 31.

The upper case 31, the lid, the lower case and the like are made of an insulative resin.

As shown in FIG. 4, the bus bar 35 of an integral construction is formed by pressing a metal sheet, and includes a plurality of tab terminals 8 to be connected to electric parts, and a connecting plate 36 interconnecting the plurality of tab terminals 8 to serve as a feeding path for these tab terminals 8.

The connecting plate 36 has a horizontal plate portion 37 extending perpendicularly from lower ends of the tab terminals 8, and a vertical plate portion 38 extending upright (that is, vertically) from a distal end or edge of the horizontal plate portion 37. The horizontal plate portion 37 extends along a lower surface of a part-mounting floor portion (which will be described later) of the upper case 31, and the vertical plate portion 38 is received in a heat-radiating wall portion (which will be described later) of the upper case 31, and is larger in size so that it can serve as a main feeding path.

As shown in FIGS. 2 and 3, the upper case 31 has a substantially box-like shape defined by the part-mounting floor portion 11, on which the electric parts are adapted to be mounted, and an upstanding peripheral wall 39 formed at the periphery of the part-mounting floor portion 11. Electric part-mounting housing portions 14, into which the tab terminals 8 can be inserted from the lower side of the part-mounting floor portion 11, and a fuse cavity 17 for enabling fuses 16 to be connected to the respective bus bars 35, are formed on and projected from the upper surface of the part-mounting floor portion 11. The bus bars 35 are mounted on the lower side of the part-mounting floor portion 11 in such a manner that the tab terminals 8 are inserted into the associated housing portions 14.

In this embodiment, as shown in FIGS. 2 and 3, the heat-radiating wall portion 41 is provided at an upper portion of the peripheral wall 39 of the upper case 31, and extends upwardly beyond the position of mounting of the electric parts on the part-mounting floor portion 11 (for example, beyond the upper edge of the fuse cavity 17 and the upper edges of the housing portions 14). The heat-radiating wall portion 41 has a bus bar installation space 43 of a slit-like cross-section which is open to the lower surface of the part-mounting floor portion 11, and the vertical plate portion 38 of the connecting plate 36 of the bus bar 35 is received in the heat-radiating wall portion 41.

In the electric junction box 30 of the above construction, the connecting plate 36 (which serves as the feeding path) of the bus bar 35, mounted on the lower side of the part-mounting floor portion 11, generates heat in accordance with the amount of supply of electric power to the electric parts connected to this bus bar 35 through the tab terminals 8, and therefore the heat is radiated from this connecting plate 36.

However, the vertical plate portion 38 (which serves as the main feeding path) of the connecting plate 36 of the bus bar 35 is received in the bus bar installation space 43 of a slit-like cross-section in the heat-radiating wall portion 41 provided at the upper portion of the peripheral wall 39 of the upper case 31, and therefore most of the heat, radiated from the connecting plate 36, is transferred through the heat-radiating wall portion 41, and is dissipated to the ambient atmosphere outside the peripheral wall 39, and thus this heat will not be kept within the upper case 31.

It is thought that part of the radiation heat from the vertical plate portion 38 of the connecting plate 36 is radiated to the interior of the case through an inner wall of the heat-radiating wall portion 41. However, the heat-radiating wall portion 41 projects upwardly beyond the position of mounting of the electric parts on the part-mounting floor portion 11 of the upper case 31, and the heat, emitted from the heat radiating wall portion 41, further rises, and is dissipated to the ambient atmosphere outside the electric junction box through the lid covering the top of the upper case 31.

Therefore, the heat, radiated from the vertical plate portion 38 of the connecting plate 36 to the interior of the upper case 31 through the heat-radiating wall portion 41, hardly exerts influences (such as a temperature rise) on the various electric parts disposed at the position below the heat-radiating wall portion 41.

Any heat-radiating vent hole, through which part of the connecting plate 36 of the bus bar 35 is exposed to the exterior of the case, does not need to be provided in the upper case 31 or other portion, and therefore the intrusion of dust and rain water into the electric junction box 30 can be prevented more effectively.

Therefore, without the need for mounting a separate duct or the like, the radiation heat from the connecting plate 36 of the bus bar 35 can be rapidly discharged to the exterior of the electric junction box 30, thereby preventing a temperature rise within the electric junction box 30, and besides a shortened lifetime of the electric connection portion due to the intrusion of dust and rain water is prevented, and the efficiency of mounting the electric junction box on the vehicle, as well as the reliability of an electrical connection treatment, is enhanced, and the cost can be reduced.

Furthermore, since the connecting plate 36 of the bus bar 35, having a relatively large area, is installed in the peripheral wall 39 of the upper case 31, there is obtained an advantage that a mounting space for other bus bar 35 and other electric part is easily available on the lower side of the part-mounting floor portion 11.

In the above embodiment, although the heat-radiating wall portion is formed by the peripheral wall extending upwardly beyond the position of mounting of the electric parts, the present invention is not to be limited to such an arrangement, and for example, the heat-radiating wall portion may be disposed at a level lower than the position of mounting of the electric parts. However, generally, when the heat-radiating wall portion is disposed at the upper position, the good heat-radiating space can be secured, and the heat-radiating effect can be obtained more easily.

For the same reason, it is preferred that the peripheral wall, forming the heat-radiating wall portion, be higher than the housing portions, but the present invention is not to be limited to such a construction.

What is claimed is:

1. An electric junction box comprising:

an upper case having a part-mounting floor portion on which an electric part is mountable, and a peripheral wall projecting from a periphery of said part-mounting floor portion;

a bus bar installation space formed in said peripheral wall; and a bus bar having a tab terminal and a connecting plate to provide a feeding path for said tab terminal, said bus bar being mounted on a lower side of said part-mounting floor portion, with said tab terminal passing through said part-mounting floor portion;

wherein said bus bar installation space receives at least a portion of said connecting plate of said bus bar.

2. The electric junction box according to claim 1, wherein said peripheral wall has a heat-radiating wall portion which extends upwardly beyond said electric part, when said electric part is mounted on said part-mounting floor portion, and wherein said bus bar installation space has a slit-like cross-section, is formed in the heat-radiating wall portion, and opens to said lower side of the part-mounting floor portion.

3. The electric junction box according to claim 2, wherein said upper case comprises an electric part-mounting housing portion, into which said tab terminal is inserted from said lower side of said part-mounting floor portion, projected from an upper side of said part-mounting floor portion, and wherein said heat-radiating wall portion projects upwardly beyond said electric part-mounting housing portion.

4. The electric junction box according to claim 1, wherein said connecting plate of said bus bar includes a horizontal plate portion extending perpendicularly from a lower end of said tab terminal, and a vertical plate portion extending perpendicularly from a distal end of said horizontal plate portion, said vertical plate portion being received in said bus bar installation space.

5. An electric junction box comprising:

an upper case having (1) a part-mounting floor portion with an upper surface upon which an electric part is mountable and a lower surface, and (2) a peripheral wall projecting from a periphery of said part-mounting floor portion, such that said upper surface and said peripheral wall define an interior space to accommodate said electric part when mounted;

a bus bar installation space provided in said peripheral wall, said bus bar installation space only opening toward said lower surface of said part-mounting floor portion, such that said bus bar installation space is isolated from said interior space; and a bus bar having a tab terminal and a connecting plate to provide a feeding path for said tab terminal, said bus bar mounted on said lower surface of said part-mounting floor portion, said tab terminal passing through said part-mounting floor portion and into said interior space for electrically connecting to said electric part;

wherein said connecting plate of said bus bar extends along said lower surface of said part-mounting floor portion and into said bus bar installation space.

* * * * *